United States Patent [19]

Clark

[11] 3,991,838

[45] Nov. 16, 1976

[54] DRILL SAMPLING DIVERSION UNIT

[76] Inventor: Barry Frederick Clark, 7 Bligh Crescent, Seaforth, Sydney, New South Wales, 2092, Australia

[22] Filed: June 2, 1975

[21] Appl. No.: 582,981

[30] Foreign Application Priority Data

May 31, 1974 Australia ..... 7743/74

[52] U.S. Cl. ..... 175/210; 175/60; 277/DIG. 6

[51] Int. Cl.[2] ..... E21B 49/02

[58] Field of Search ..... 175/60, 84, 209–212; 277/DIG. 6, 72 R; 166/82, 84

[56] References Cited

UNITED STATES PATENTS

| | | | |
|---|---|---|---|
| 2,145,192 | 1/1939 | Pennington | 175/210 |
| 3,173,502 | 3/1965 | Overby | 175/210 |
| 3,788,423 | 1/1974 | Nittinger | 175/209 X |
| 3,841,421 | 10/1974 | Matsushita | 175/212 |
| 3,868,832 | 3/1975 | Biffle | 175/84 X |

*Primary Examiner*—Ernest R. Purser
*Assistant Examiner*—William F. Pate, III
*Attorney, Agent, or Firm*—Stevens, Davis, Miller & Mosher

[57] ABSTRACT

A self-centralizing sealed diverter for aiding the surface collection of underground samples including a rigid casing driven into the ground to line a partially drilled hole, a rigid chamber mounted above and firmly but removably attached to the casing to receive drill samples, a sleeve fastened to the top of the chamber and including a stuffing box having a self-lubricating stuffing gland which lines the box, a journal removably mounted on the top of the sleeve for journalling a drill rod and for axially locating initially the stuffing gland, a casing including a bearing for aligning the rod with respect to a drill head, a protective top-plate attached to the bearing casing, and a pressed-in bush interposed between the rod and the bearing.

9 Claims, 3 Drawing Figures

DRILL SAMPLING DIVERSION UNIT

Figure 1:
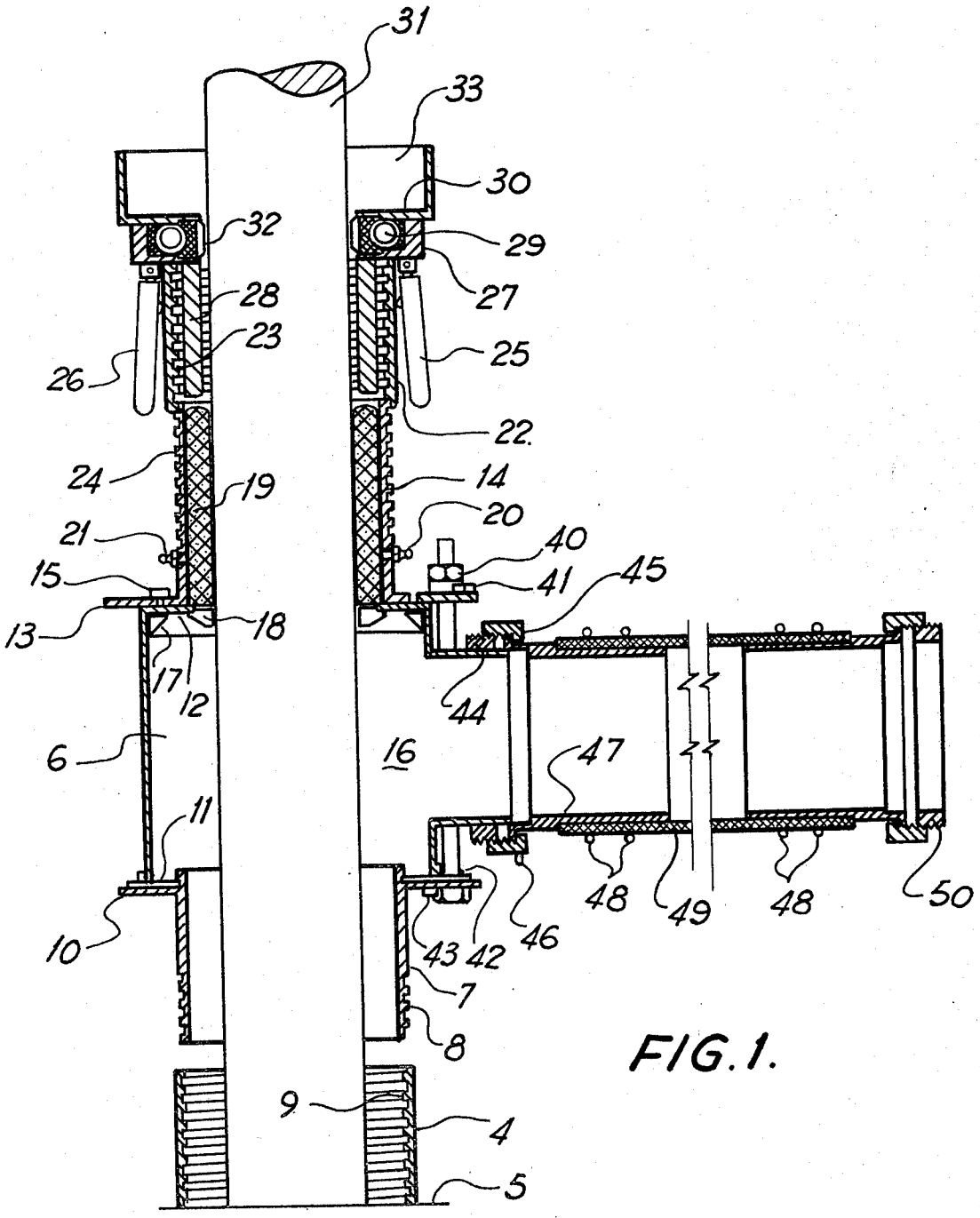

This invention relates to drill sampling, and more particularly to an improved kind of drill sampling diversion unit.

It is desirable, especially during so-called "percussion drilling", to be able to bring underground samples from the ground, each comprising the entire material extracted over an interval of say 10 feet, and to lodge these samples in a suitable receptacle above ground, the samples being ultimately segregated so as to indicate the nature and progress of a drilling site. Such drilling may, for example, be a relatively low cost preliminary measure for establishing the general presence or distribution of minerals, and may be confirmed later by relatively expensive diamond drilling.

In percussion drilling it is customary for air to be used to power a hammer or bit fastened to the lower end of a drill rod or an interconnected collinear assembly of such rods, and also to bring the cuttings up to the surface to a collection chamber which rests upon the ground surface. Under dry conditions this action usually results in an undesirable dust-cloud at the drilling site, and hence the mixture of air and cuttings has usually been drawn off via a hose or pipe to a socalled cyclone which encloses and collects said dust.

However, such systems have suffered from various disadvantages. For example, difficulty has been experienced in holding and retaining a complete sample, because insufficient velocity along the hose leading to the cyclone may cause the hose to clog with particles of solid material. Also, any deficiency in the sealing means for the chamber allowed dust to be blown out and lost through the top of said chamber. Furthermore, any water located during drilling, and hence forced up to the surface by the air, would merely lift the chamber clear of the ground upon which it normally rested, thereby spilling at least part of the sample.

It is an object of the present invention to overcome the above and other disadvantages.

In accordance with the invention therefore, in one of its aspects, a self-centralizing sealed diverter for aiding the surface collection of underground samples produced by a drilling rig of the kind which employs fluid extraction comprises, in combination, a. a rigid casing driven into the ground to line a partially drilled hole, b. a rigid chamber mounted above and firmly but removably attached to said casing via sealing means and adapted to receive and retain drill samples, c. a sleeve fastened to the top of said chamber and having therein a flexible and at least partly self-lubricating stuffing box, d. journalling means removably mounted upon the top of said sleeve for journalling one or more drill rods entering said sleeve from above, and also for axially locating initially a stuffing gland which lines said box, e. one or more bearings which align said drill rod or rods with respect to a drill head, f. a protective top-plate attached to a casing of said bearing or bearings, and g. a pressed-in bush interposed between said rod or rods and said bearing and composed of material harder than the material of said rods.

Figure 2:
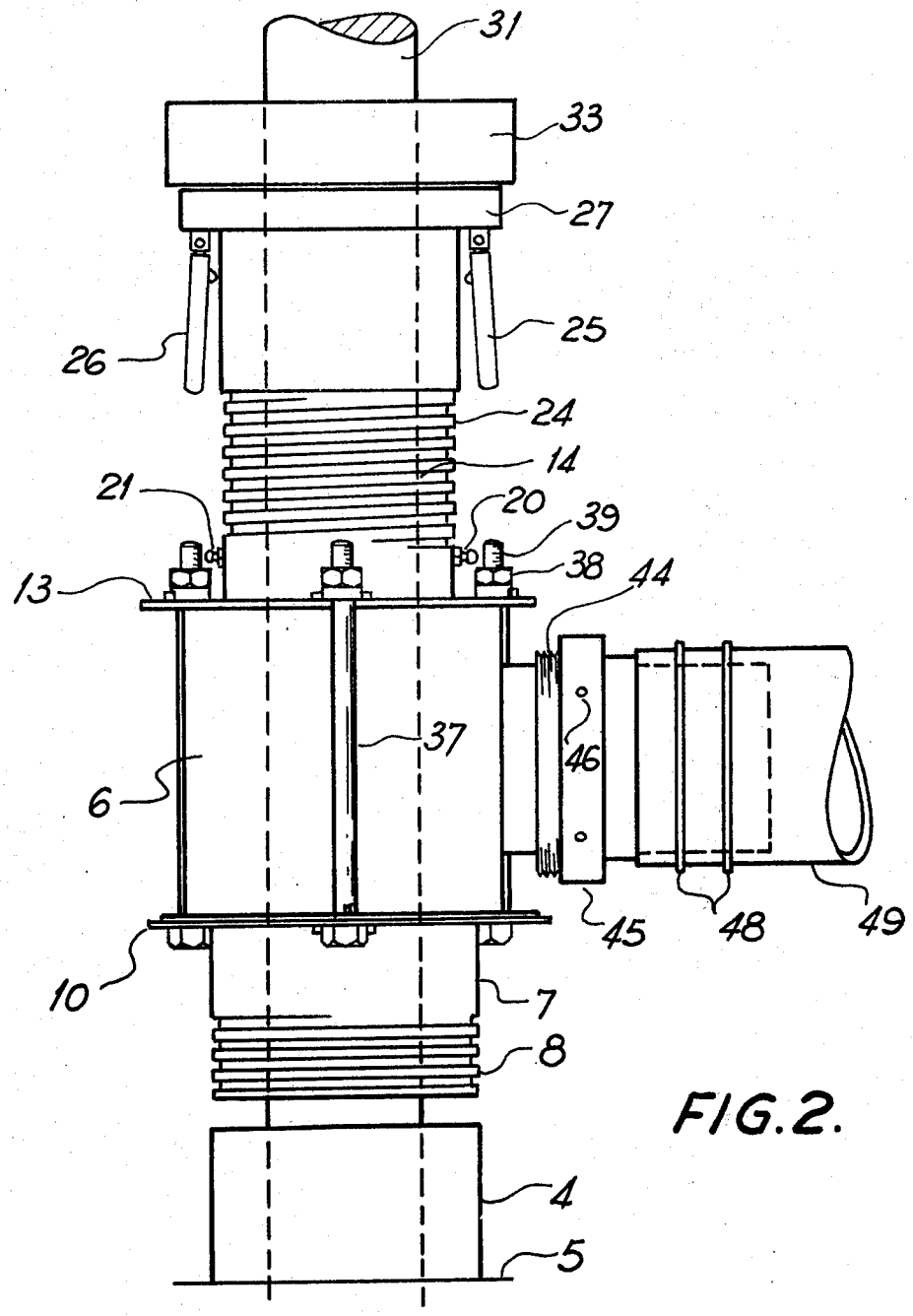
Figure 3:
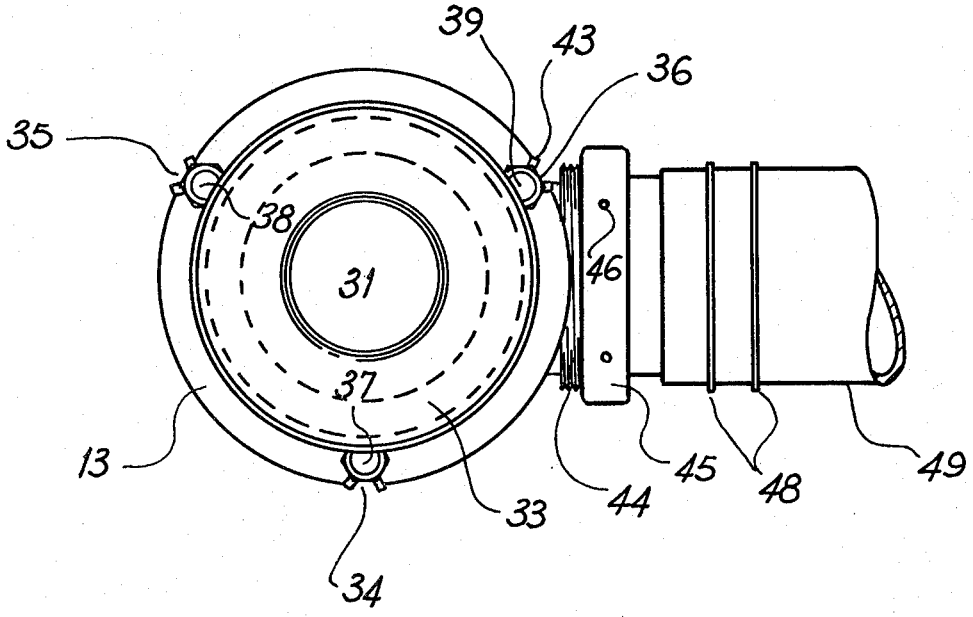

One particular embodiment of the invention defined in the preceding paragraph will now be described herein with reference to the accompanying drawings, in which similar references indicate corresponding parts, and in which:

FIG. 1 shows, in front elevation and partly in section, a diverter with a single drill rod journalled therein, FIG. 2 shows the apparatus of FIG. 1 in front elevation, and FIG. 3 shows, in plan view, the apparatus of FIG. 2.

Upon referring to the drawings it will be seen that a main casing 4 composed of steel tubing or the like is driven into a partially drilled hole in the ground 5. A rigid chamber 6, which may be composed of similar material, is sealed with respect to a stub-length of casing 7 by welding or otherwise. The stub-length 7 is mounted removably with respect to the main casing 4 by means of the co-acting screw threads 8 and 9. The stub-length may, for example, be made by cutting a portion (say 6" or half a connecting nipple) from a standard length of the main casing, upon each end of which a thread is normally provided.

The baseplate 10 of the chamber 6 is made somewhat oversize to suit a range of alternative casing sizes, to obviate the need for an adaptor, and is held sealingly in contact with the walls of the chamber via the gasket 11, composed of rubber or the like.

The top wall 12 of the chamber is attached to the hold down flange 13 of the sleeve 14 by means of lugs such as 15, which may be four in number. These lugs prevent any upward movement of the flange 13, but enable it to be rotated to orient the diversion chamber 16 as desired.

The chamber 6 may be strengthened near its top wall 12 and also modified in profile by means of an internal fillet 17.

A hardened bush 18 is set in and welded on edge to the radially inner edge of the top wall 12. The sleeve 14 and the bush 18 thus constitute a stuffing-box which retains the stuffing gland 19, which may be composed of low-friction material such as polypropylene rope, or any similar material which withstands the effects of heat and which does not readily fragment. If desired, grease may be applied to the surface of said rope to augment its lubricating properties. For this purpose suitable grease nipples such as 20 and 21 may be provided in the sleeve 14.

The outer sleeve 22 engages the sleeve 14 by rotation thereabout, via the respective screw threads 23 and 24. This rotation may be carried out manually by means of the foldable handles 25 and 26, which are hinged to the bearing holder 27, attached in turn by welding or otherwise to the top of the outer sleeve 22. Rotation of the bearing holder in the appropriate sense causes the ram 28 to urge the stuffing gland 19, during assembly, down into the position shown.

Bearings such as 29 are located within the bearing holder 27, and are covered by a protective top plate 30, which prevents damage to the bearing by tools, such as stilsons, which are used for breaking the rods 31. If desired, one or more further similar bearings may be installed, for example, near the lower end of the sleeve 14.

Because of the presence of the bearing or bearings, the alignment of the rod or rods with respect to a drill head (not shown) is assured, thus preventing any unnecessary wear upon, or even damage to, the stuffing gland 19.

A pressed-in bush 32 may be installed so as to permit very little play (e.g. approximately 1/64" per side) between the rod 31 and the bearings 29. It will be seen that the bushes 18 and 32, being the most expendable items in the assembly, are those most easily replaced.

An oil reservoir 33 may be removably located above the protective top-plate 30, so providing continuous lubrication of the rods (which may, alternatively, be coated manually by means of a brush).

The slots 34, 35 and 36 simplify the setting of the respective bolts 37, 38 and 39 in position without removing the nuts such as 40, which are otherwise always in danger of being dropped down the drillhole. The lugs such as 41 and 42 prevent bolts such as 39, once tightened in position, from slipping sideways off the flange 13 and baseplate 10 respectively.

The bolt head stops such as 43 prevent the bolts such as 39 from turning while being tightened, but allow the bolts to swing outwards in their locating holes, which are slightly elongated radially for this purpose.

The hose coupling means on the diversion chamber 16 comprises a threaded ring 44 engaged by a threaded round nut 45, with say four round pegs such as 46, a flanged connecting tube 47, attached via clips 48 to a self-supporting, slightly flexible, high-density hose 49 of great strength, such as that marketed under the trade mark HELIFLEX, with similar fittings at the output or right-hand end. Said output end may terminate in a threaded ring 50 which may be fastened to a user's drill sample collecting equipment, which is thereby ready for instant use in association with the diverter.

The chamber 6 may be lined with an abrasionresistant coating such as that marketed under the trade mark LINATEX.

Apparatus constructed in accordance with the invention has a number of advantages over prior known systems. For example, the invention overcomes the usual bearing and sealing problem caused by the inevitable roughness of the drill rods 31, which are made even rougher in use by contact with stilsons. Also, the usual lifting and hence leakage problems are solved by the installation of an "anchoring" casing near the top of the drill-hole as above described. Also, any oil present in the system tends to mix with dust, and is pushed by air pressure back up into the sealing means in the form of a paste, thus making the sealing arrangements even more effective. Furthermore the invention overcomes the alignment problem which is inherent in view of the fact that the chamber 6 is desirably mounted between the upper sealing means and the lower casing. That is, the drill head, the casing 4 and the chamber 6 are all kept in close alignment.

The invention is useful in any kind of percussion drilling using a fluid medium such as air, water or mud. It is, however, especially useful in the case of air, the high velocity of which usually renders this particular fluid difficult to control.

I claim:

1. A self-centralizing sealed diverter for aiding the surface collection of underground samples produced by a drilling rig of the kind which employs fluid extraction comprising, in combination, a. a first rigid casing driven into the ground to line a partially drilled hole, b. a rigid chamber mounted above and firmly but removably attached to said first casing via sealing means and adapted to receive and retain drill samples, c. a sleeve fastened to the top of said chamber and having therein a stuffing box having an at least partly self-lubricating stuffing gland which lines said box, said sleeve being movable laterally with respect to said rigid chamber, d. journalling means removably mounted upon the top of said sleeve for journalling at least one drill rod entering said sleeve from above the jounalling means, and also for axially locating initially said stuffing gland which lines said box, e. a second casing including at least one bearing for aligning the drill rod with respect to a drill head, f. a protective top-plate attached to said second casing of said bearing, and g. a pressed-in bush coupled to said bearing to be interposed between the rod and said bearing, said bush permitting little play between said bearing and the rod and being composed of material harder than the material of the rod.

2. A diverter as claimed in claim 1, wherein said chamber is adapted to be oriented within a substantially horizontal plane and fixed at any angle with respect to said first casing.

3. A diverter as claimed in claim 1 wherein said second casing further includes handles hinged to said second casing and ramming means, said ramming means being axially movable by said handles and adapted to urge said gland into said stuffing box during assembly of said diverter.

4. A diverter as claimed in claim 1 further comprising grease nipples which penetrate the walls of said sleeve to supply said gland with added lubricant.

5. A diverter as claimed in claim 1 wherein said gland comprises polypropylene rope.

6. A diverter as claimed in claim 1 further comprising an oil reservoir removably located above said top-plate to provide continuous lubrication to the drill rods.

7. A diverter as claimed in claim 1 wherein said chamber is provided with coupled output means for the samples, said output means including a flexible, high-density hose.

8. A diverter as claimed in claim 1 wherein said chamber is lined with an abrasionresistant coating.

9. A diverter as claimed in claim 1 wherein said sleeve is removably fastened to the top of said chamber by axially directed peripheral captive bolts which engage apertures in a flange extending from the lower end of said sleeve, and which also engage further apertures in a base plate extending from the lower end of said chamber.

* * * * *

Disclaimer 3,991,838.—*Barry Frederick Clark*, Seaforth, Near Sydney, Australia. DRILL SAMPLING DIVERSION UNIT. Patent dated Nov. 16, 1976. Disclaimer filed Feb. 9, 1977, by the *Inventor*.

Hereby enters this disclaimer to the entire remaining term of said patent.

[*Official Gazette May 24, 1977.*]